US006442991B1

(12) United States Patent
Rojek

(10) Patent No.: US 6,442,991 B1
(45) Date of Patent: Sep. 3, 2002

(54) DEVICE FOR STRETCHING AND MOLDING CAN BODIES

(75) Inventor: Arnaldo Rojek, São Paulo (BR)

(73) Assignee: Metalgrafica Rojek LTDA., Sao Paulo (BR)

( * ) Notice: Subject to any disclaimer, the term of this patent is extended or adjusted under 35 U.S.C. 154(b) by 0 days.

(21) Appl. No.: 09/604,767

(22) Filed: Jun. 28, 2000

(30) Foreign Application Priority Data

Oct. 27, 1999 (BR) ..... 9905474

(51) Int. Cl.[7] ..... B21D 19/12
(52) U.S. Cl. ..... 72/352; 72/370.06; 72/379.4
(58) Field of Search ..... 72/343, 352, 355.4, 72/356, 370.06, DIG. 101, 379.4; 413/69

(56) References Cited

U.S. PATENT DOCUMENTS 2,013,654 A * 9/1935 Hothersall ..... 72/353.2
2,506,657 A * 5/1950 Webster ..... 72/356
3,344,647 A * 10/1967 Berger ..... 413/69

FOREIGN PATENT DOCUMENTS

DE 2128999 * 1/1973 ..... 413/69
GB 649346 * 1/1951 ..... 72/FOR 101

* cited by examiner

*Primary Examiner*—Lowell A. Larson
(74) *Attorney, Agent, or Firm*—McDermott, Will & Emery

(57) ABSTRACT

"CAN BODY STRETCHING AND MOLDING DEVICE" comprised by a hard and solid forming block (1) in steel or any other harder material, generally cylindrical which presents the biggest part of its height with a larger diameter corresponding to the inner diameter of the can already stretched having on its upper part a conic section (3) topped by a short cylindrical section with smaller diameter corresponding to the inner diameter of the can body to be stretched; said forming block (1) receives from below, where it seats, a flange forming tool at the lower part of the can body, said tool formed by a steel disk (5) having a circular groove (6) in fluting section, susceptible to be reached and taken by the lower end of the can body on its stretching and molding process; it is further provided a flange forming tool on the upper part of the can formed by a steel disk (10) provided on its lower face with a circular groove (11) of fluting section and having a small circular and salient section (12) which surrounds the inner periphery of the groove (11), said salient section (12) susceptible to be maintained by coupling on the upper end of the can body (2) that will go through the stretching and molding process.

7 Claims, 10 Drawing Sheets

Figure 1:
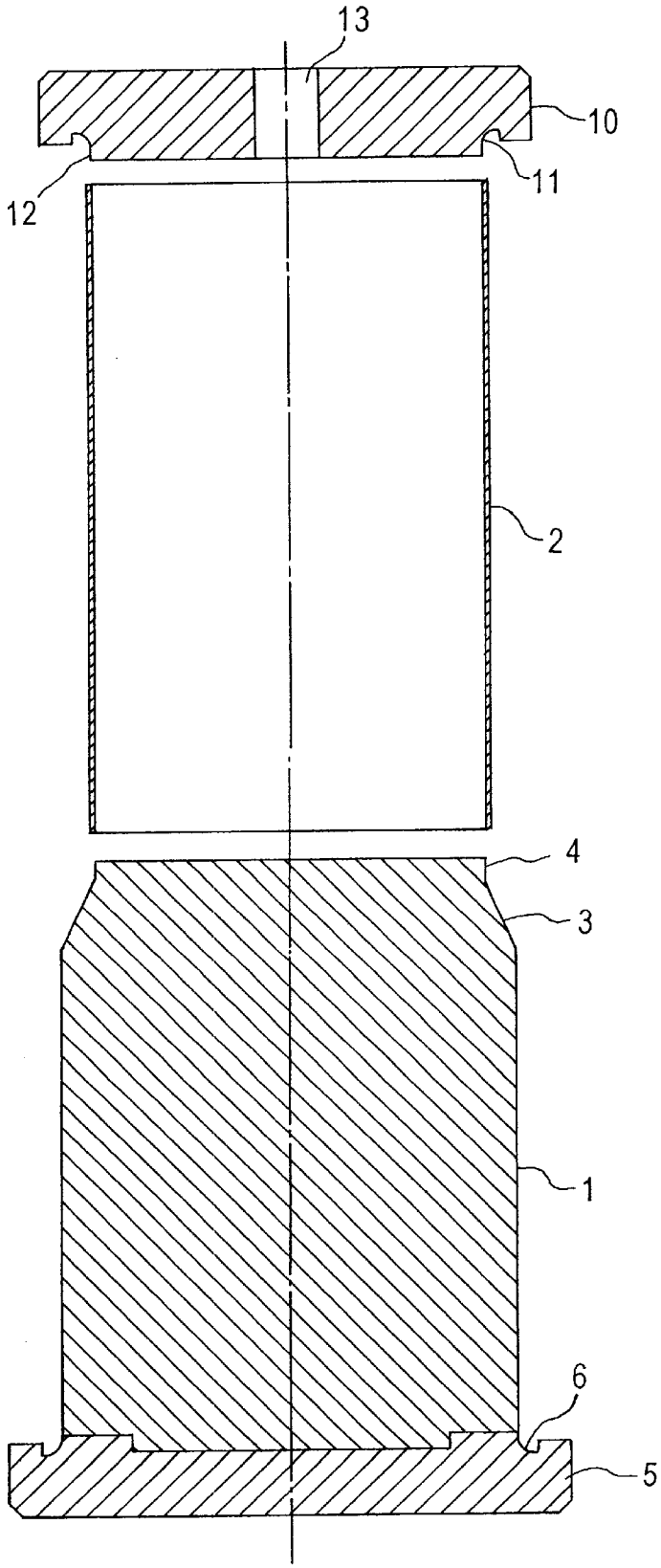

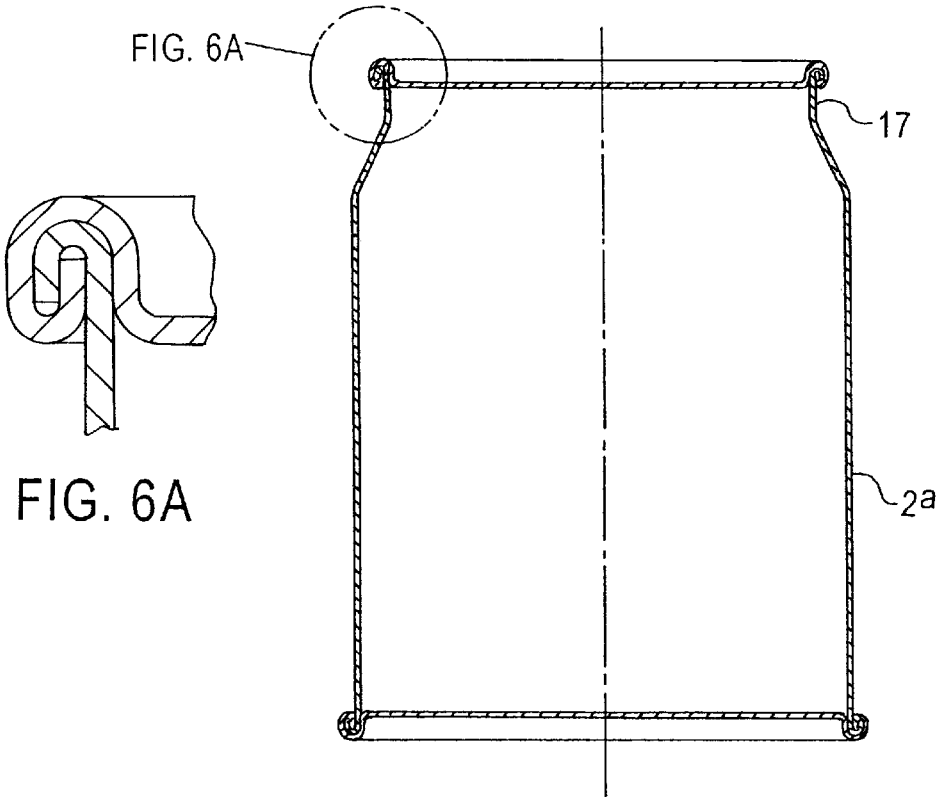
FIG. 6A
FIG. 6
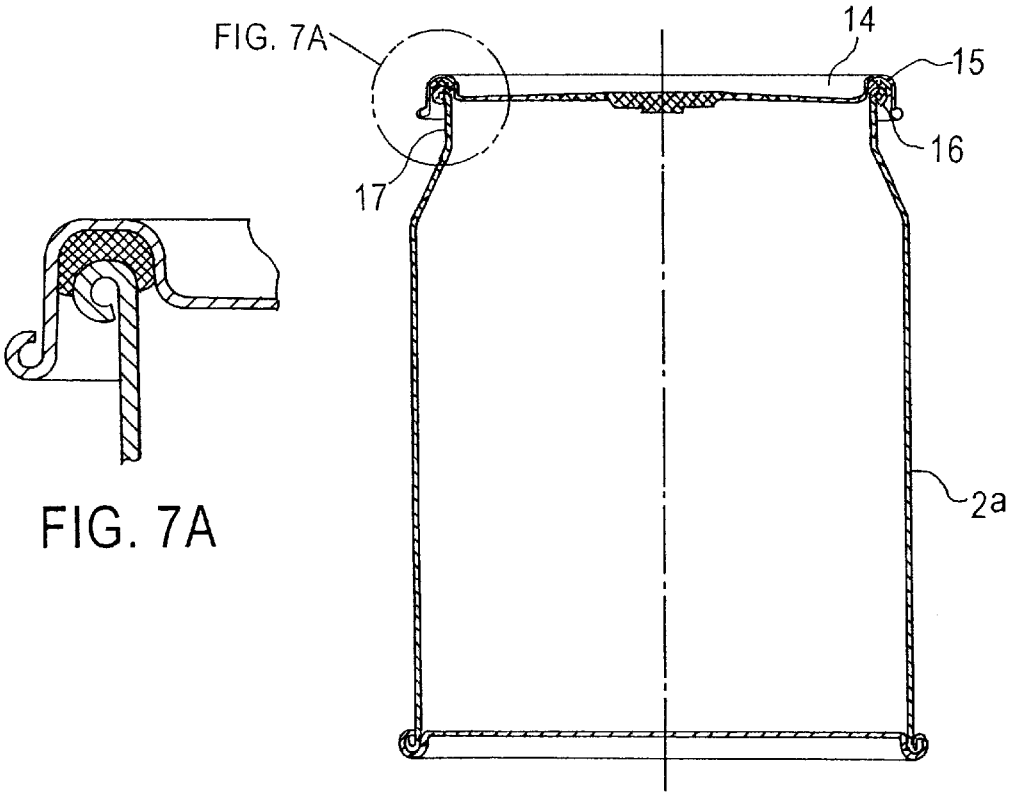
FIG. 7A
FIG. 7

DEVICE FOR STRETCHING AND MOLDING CAN BODIES

This invention is related to a device that will provide the stretching and molding of can bodies, more specifically for cans manufactured with tinplate and destined for food packaging, through which, and due to its special building and working features, the stretching and molding and consequent growth of the diameter of the can body, is obtained by an extremely practical and efficient way, by means of one single operation, thus excluding the need for equipment with great complexity and high cost as other methods known and used for the same purposes.

The expansion of this kind of cans, always seeking for more raw material savings and cost reduction on metal packaging, is now obtained by means of extremely complex expanding devices, normally made out of rules of cleats, rulers or tongs, which are introduced into the can body to be expanded and, when driven, said devices open or dilate, projecting themselves against the inner sidewall of the can body, causing its expansion and subsequent diameter growth relative to the ends that will be closed by lids by seaming operation.

This procedure obtained by means of these known expanding devices, through which only the expansion of the can body is obtained, although satisfying their purposes to a certain extent, besides their complex building form and high cost, they have their function restricted merely to the can diameter increase, in order to afford higher volumetric capacity of the can body.

The stretching and molding device for can bodies in reference, comes to solve that problem in a much practical and definitive way, substantially differentiated from the known devices by both, its building and its operational form, essentially comprised by a rigid and solid forming block, generically cylindrical, which constitutes at the same time, the stretching or molding element, which presents the larger area of its body with a bigger diameter corresponding to the inner diameter of the can body to be obtained by stretching and having a conic section that is topped by a short cylindrical section which diameter is smaller than the one of the bottom portion of the forming block.

This forming block, that constitutes an essential part of the stretching and molding device, either penetrates or receives under pressure the cylindrical body of the can, that has originally a smaller diameter, simply rolled and electrically welded, thus allowing its stretching and formation, molding itself to the outer surface of the forming block and having the greatest part of its body augmented in diameter relative to the diameter of the upper end, that remains with its original diameter, forming what is known as neck-in, all that through a single operation, which is complemented by tooling applied to the upper and lower parts of the assembly, through which, on the same stretching and molding operation, flanges are obtained at the ends of the stretched and formed can body, destined to allow the application of the forming disks for bottom and top can lids on a subsequent seaming operation.

The stretched and formed can body by means of said device, still will might have its upper end of smaller diameter forming the can top provided with a plump cord upturned outwards, by the use of a complementary tool and operation, to allow the can to receive a non seamed metal lid and be closed thereby, said metal lid being provided with sealing gaskets and vacuum closed, of the easy-open kind.

Figure 2:
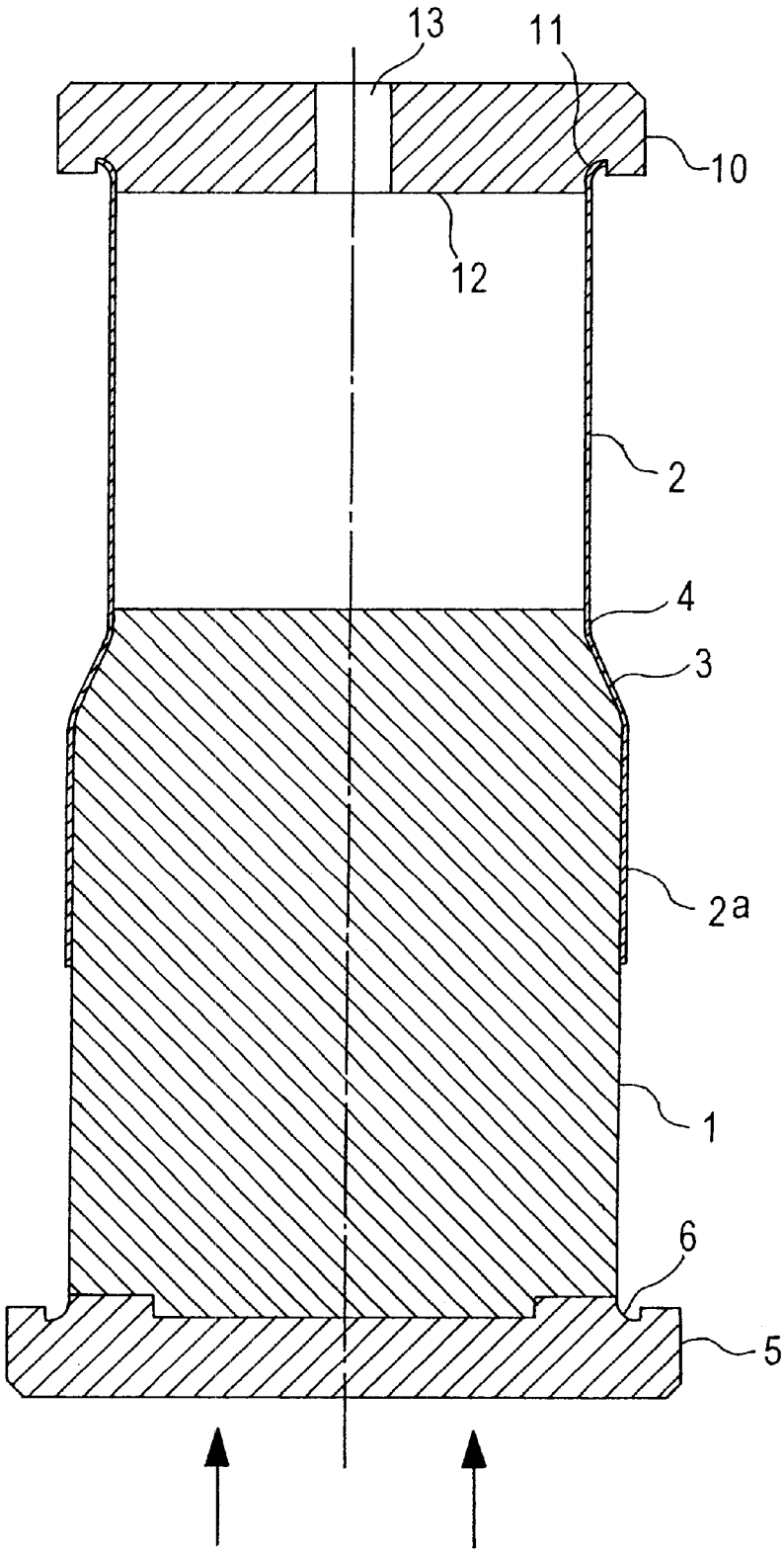
Figure 3:
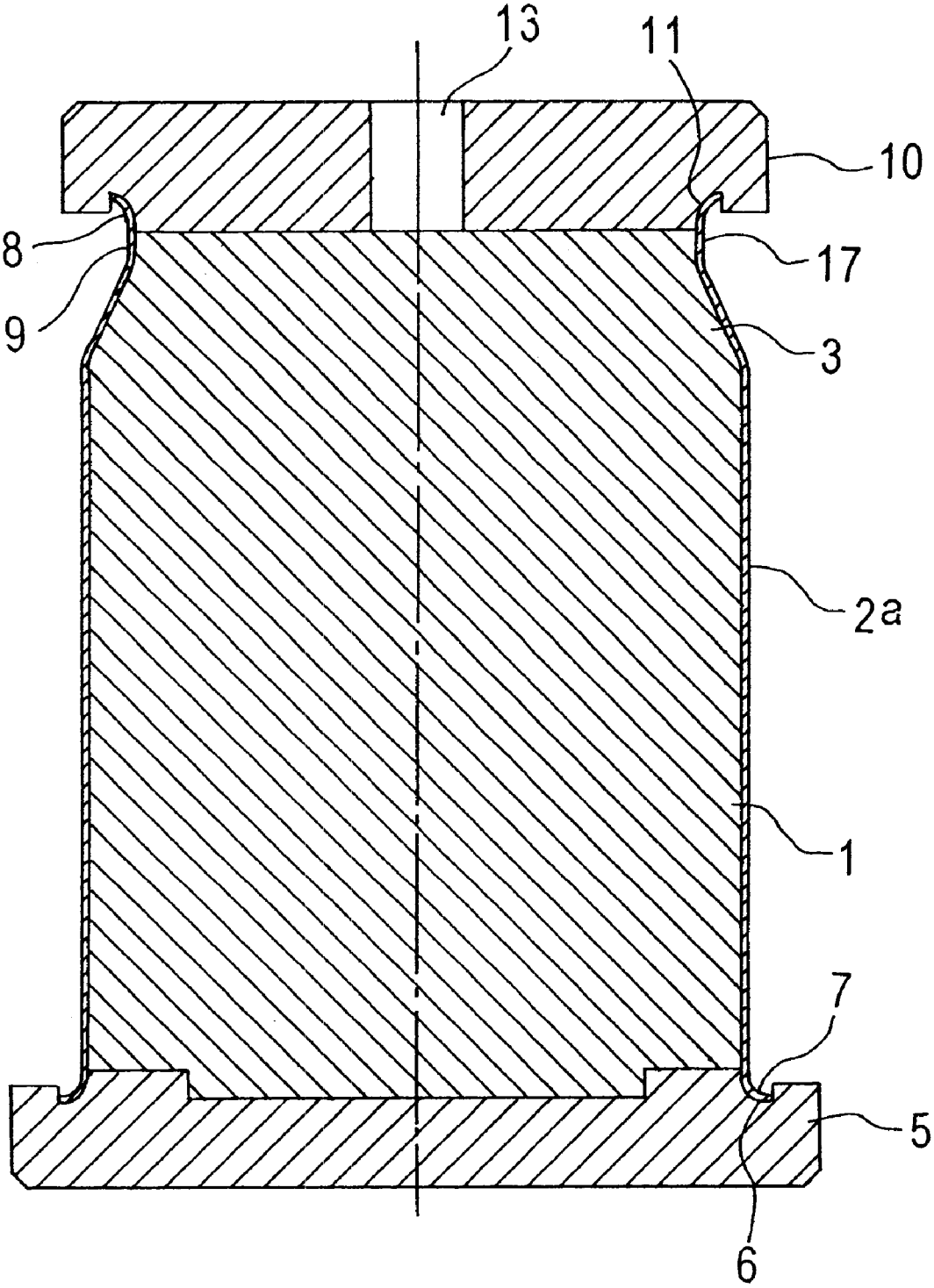
Figure 4:
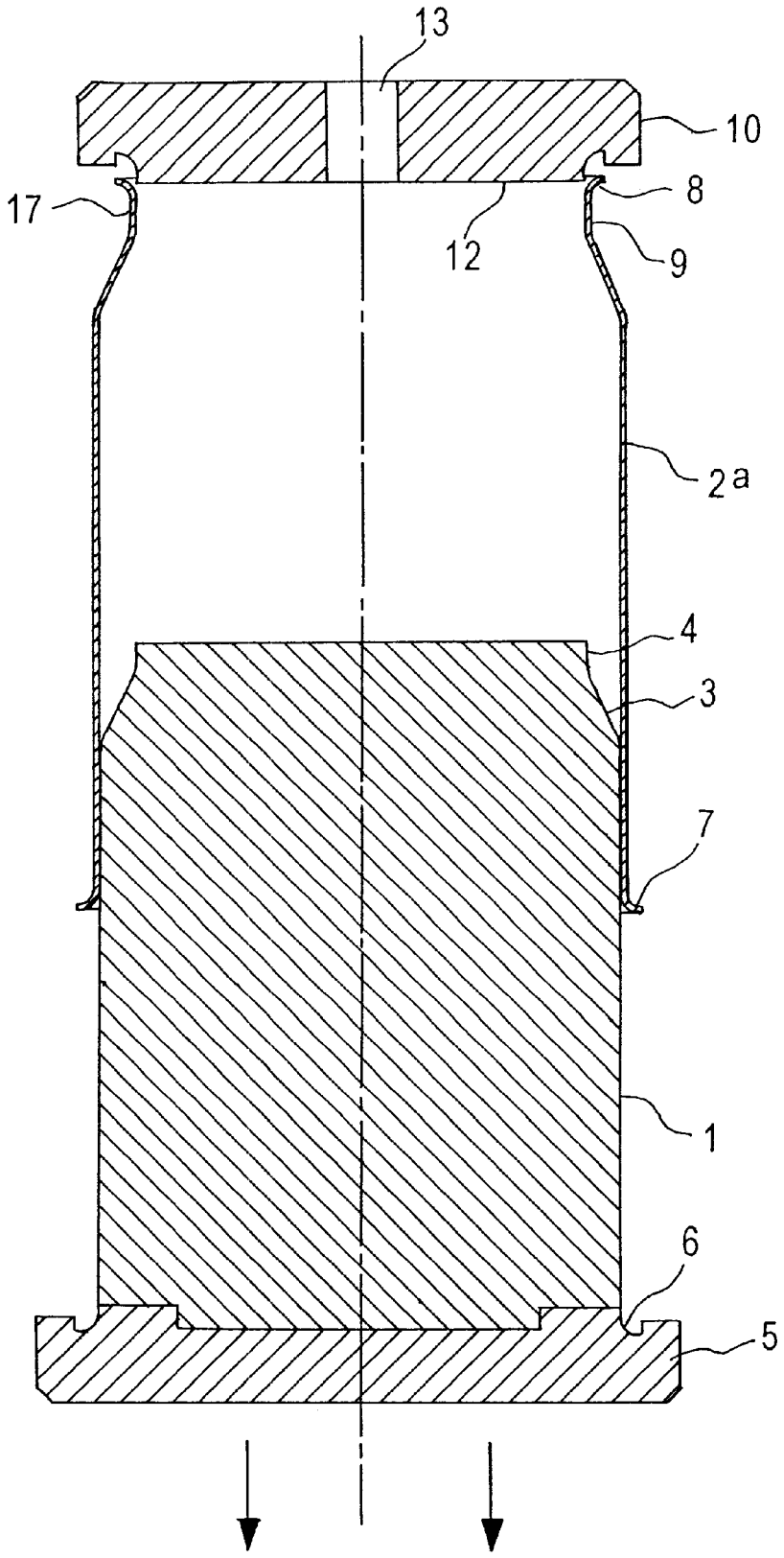
Figure 5:
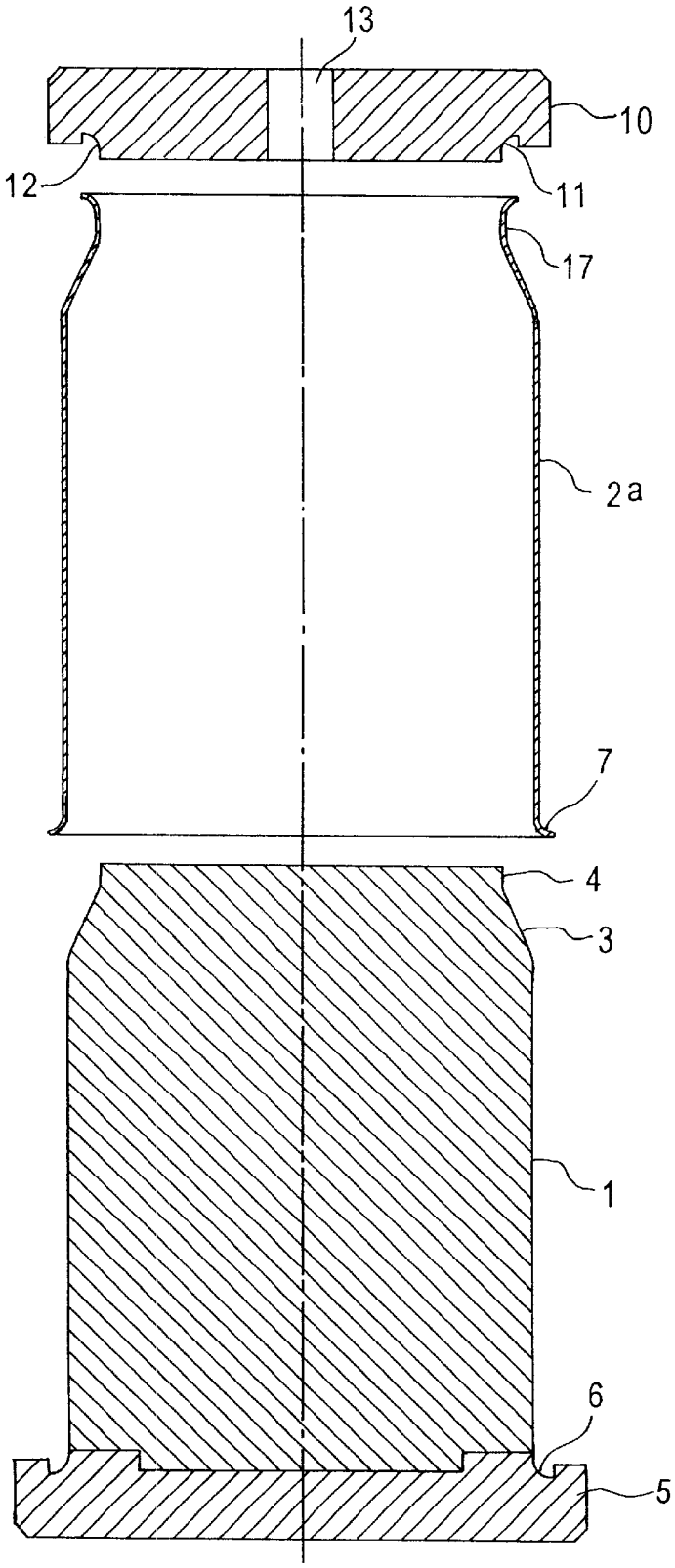
Figure 8:
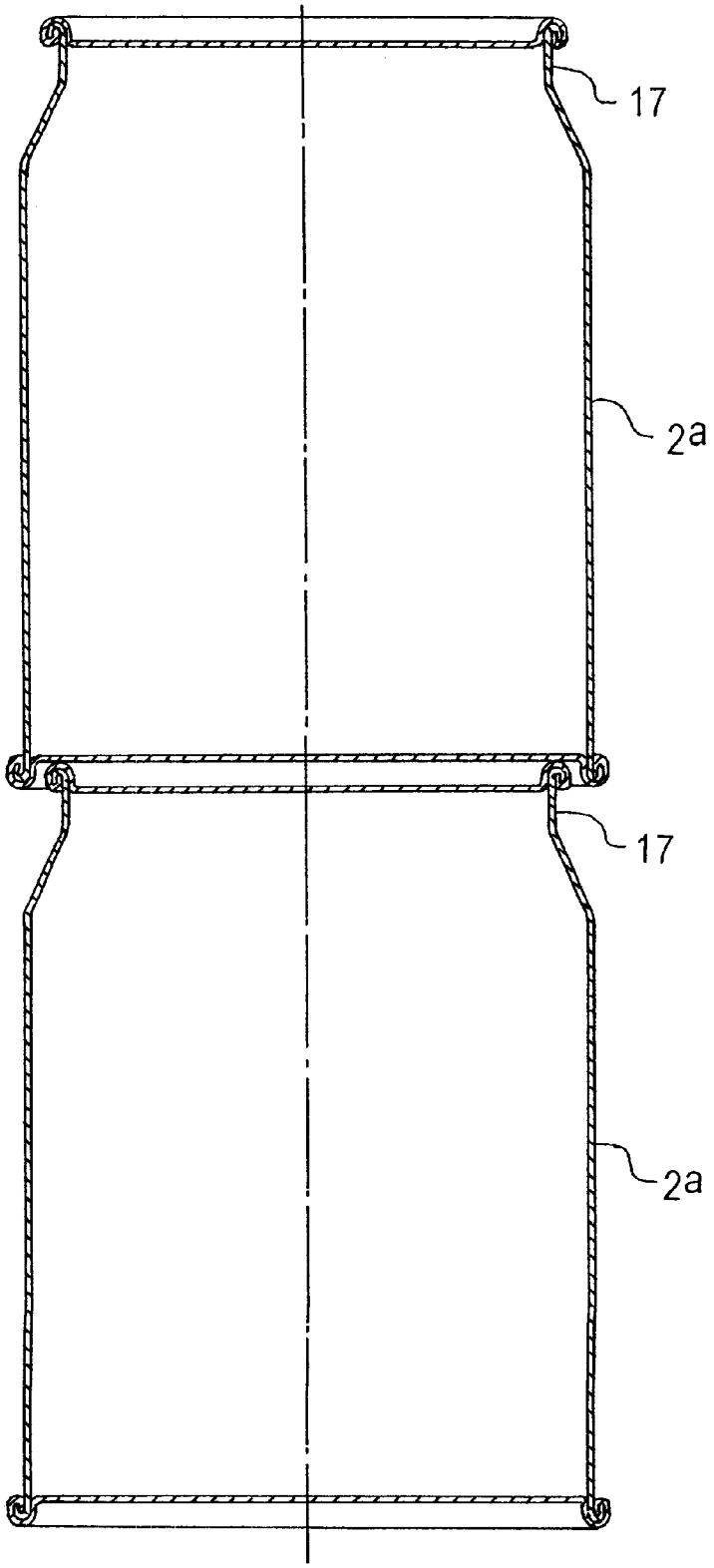
Figure 9:
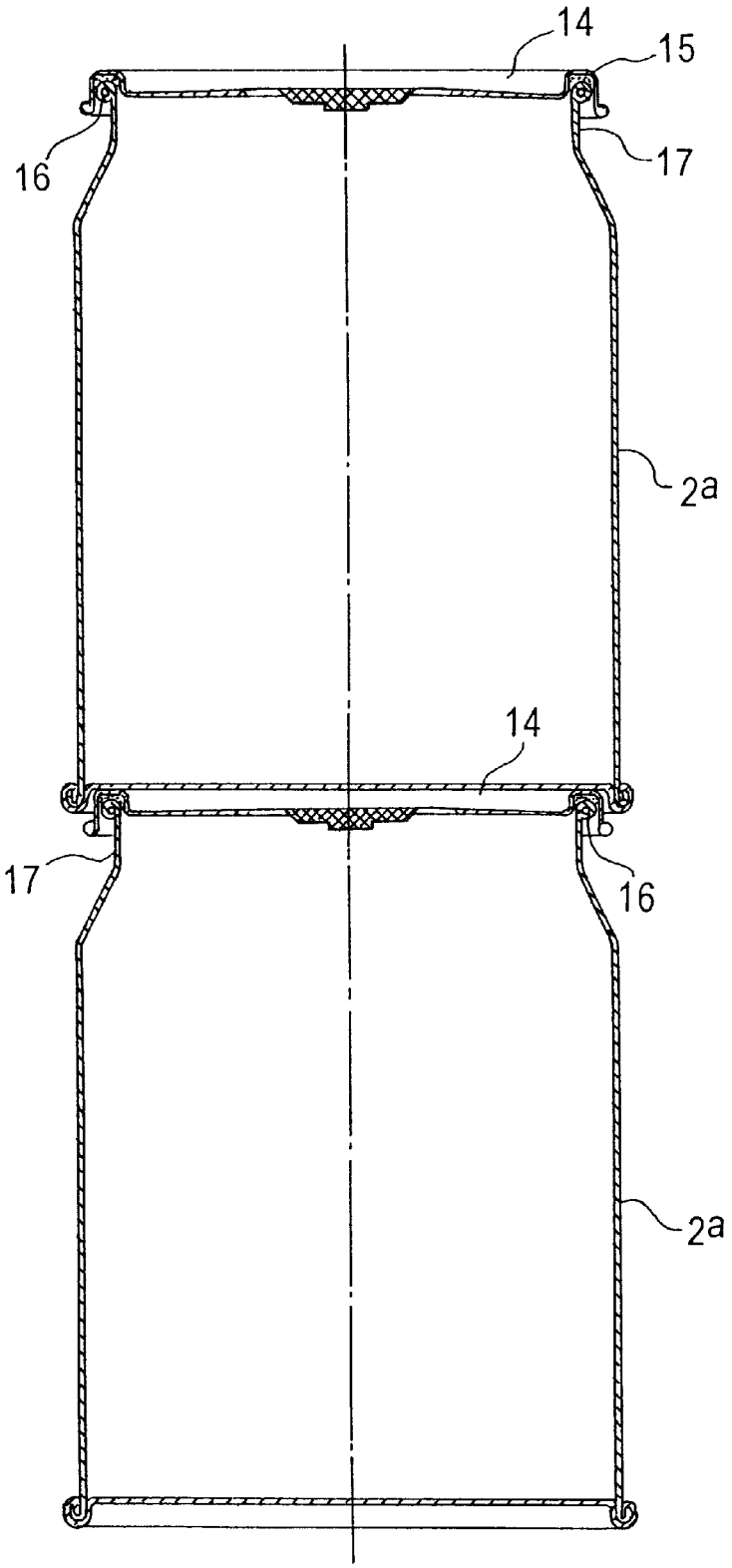
Figure 10A:
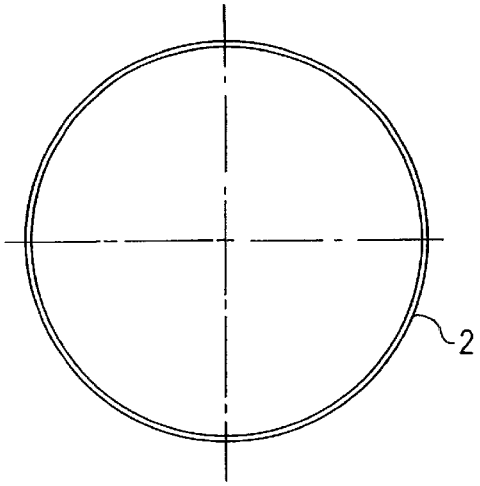
Figure 11A:
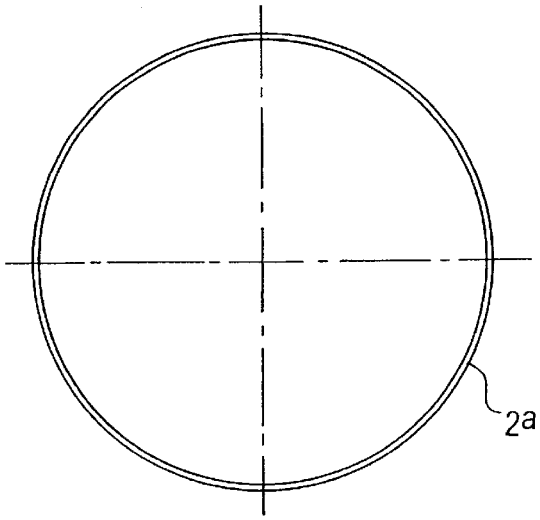
Figure 10:
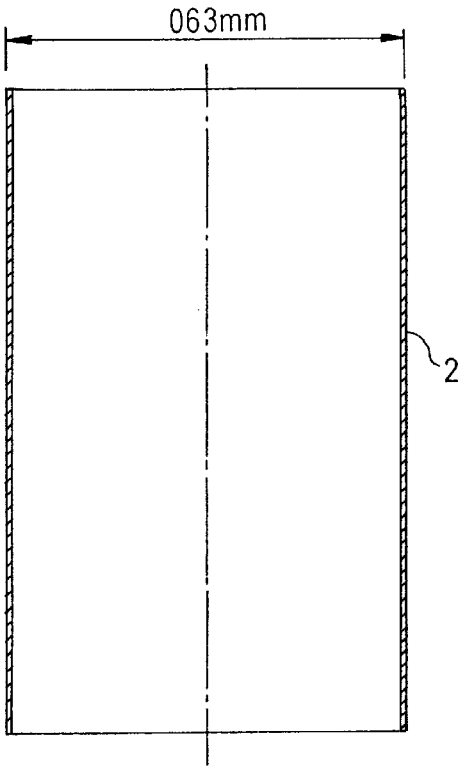
Figure 11:
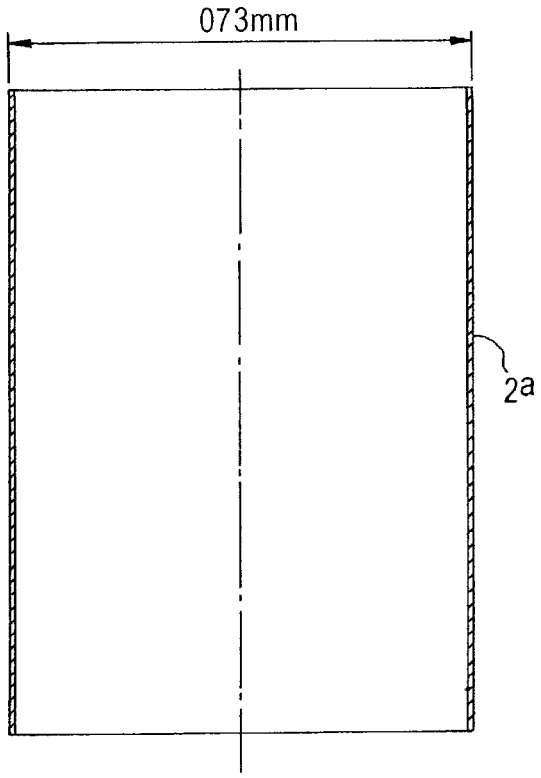

The attached drawings show the mentioned can bodies stretching and molding device, as well as its working way, which include:

Sheet 1—FIG. 1—side and diametrical section view of the device, having in the upper part a cylindrical can body about to go through the stretching and molding process, and in the lower and upper part the tools destined to allow the flanges formation;

Sheet 2—FIG. 2—side and diametrical section view showing the device at the first operational phase, penetrating under high pressure on the can body, which has its diameter growing by stretching and being molded at the same time to the body of the forming block;

Sheet 3—FIG. 3—side and diametrical section view showing the stretching and molding device on its last working phase, having the can already stretched and formed and with its upper and lower ends provided with flanges, obtained on the same operation;

Sheet 4—FIG. 4—side and diametrical section view showing the stretching and molding device being extracted with the can body already stretched and formed;

Sheet 5—FIG. 5—side and diametrical section view showing the can body completely released from the device upon operation of stretching and molding and ready to receive the lid and bottom by seaming on a subsequent operation;

Sheet 6—FIGS. 6 and 7—side and diametrical section views of cans already closed by lids, which body was obtained by the stretching and molding device, being that of FIG. 6 with its seamed lid, and that of FIG. 7 closed by the non seaming lid, that close by vacuum and is of the easy-open kind;

Sheet 7—FIG. 8—side and diametrical section view showing the two cans with seamed lids, one on the top of the other with smaller diameter of upper part or top allows an easy and safe stackeability at selling stores;

Sheet 8—FIG. 9—side and diametrical section view showing two cans with their tops closed by non seaming lids of the easy-open kind, with the same easy stackeability;

Sheet 9—FIGS. 10 and 11—side and diametrical section view, and a plant view, showing for comparing purposes a cylindrical can body, originally with a 63 mm diameter (FIG. 10) which, when submitted to the stretching process, comes to correspond to a 73 mm can body (FIG. 11)

Figure 12:
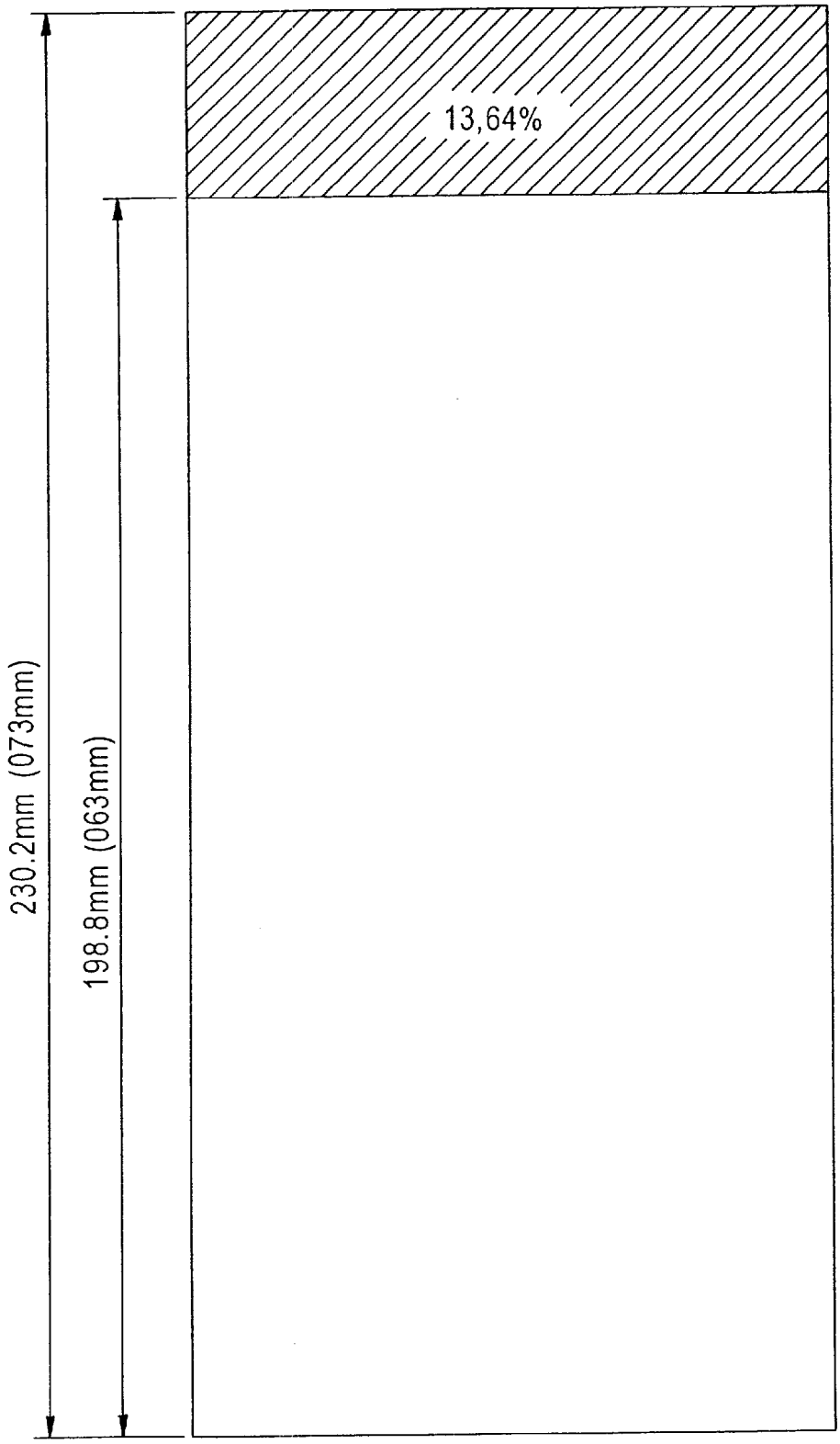

Sheet 10—FIG. 12—plant view of an plain open can body, showing to exemplify and to elucidate the economy of plate obtained in the formation of an stretched can, where a plain plate with 198,8 mm length, which normally corresponds to a can with 63 mm diameter, allows to obtain a 73 mm diameter can, which plate length needs to be 230.2 mm, saving 13.64% of plate, as shown on the shaded part of this figure, all that per unit produced.

Describing the invention in further detail and as shown in the drawings attached to the present specification, the can body stretching and molding device in reference is formed by a hard and solid forming block in steel or other harder material, with generally cylindrical section, which presents the greatest portion (1) of its height with a bigger diameter which corresponds to the inner diameter of the can to be stretched, which is offered formed by a can body (2) with diameter originally smaller than that resulting of the stretching and molding process by the device, which body normally is electrically rolled and welded.

This device formed by the hard block presents in its upper part a conic section (3) which is topped by a small cylindrical (4) section of smaller diameter relative to the section (1) of bigger height, being that said forming block receives from bellow, on its base, a complementary tool, formed by a steel disk (5), provided on its upper face with a circular groove (6) in fluting shape, which is reached by the lower end of the can body (2) in its stretching and molding process thereby allowing the formation of the flange (7) in the lower part of the can (as shown in FIG. 3).

The assembly is completed by a second complementary tool, destined to forming, on the same stretching and molding operation, the flange (8) at the upper and of smaller diameter end (9) of the can body, said tool being formed by a steel disk (10) which presents on its lower face a circular groove (11), which is reached by the upper end of the can body (as shown in FIGS. 2 and 3) at the end of the stretching and conforming process, said disk is provided at its bottom by a short salient section (12) which surrounds the inner part of the groove (11), which diameter corresponds to the inner diameter of the cylindrical body (2) of the can to be stretched and formed, on which it couples internally, being this disk (10) what forms the tool, it is provided on its center with a vertical hole (13) destined to allow the air to escape, thus making the can body (2) stretching and molding operation easier and smoother.

This flange forming tool (8) of the upper part might be replaced by another tool or more adequate device in the case of obtaining cans destined to be closed by vacuum easy-open non seaming lids (14) (as shown in FIGS. 7 and 9), provided with sealing gaskets (15) and detachable seal (15*a*), in this case the can upper edge having smaller diameter on its upper part, provided with a plump cord (16) rolled outwardly, obtained by that tool or complementary device, said cord allowing the gasket of this lid to seat and to hermetically close by vacuum action.

Thus, the forming block (1), which comprises the main part of the stretching and molding device, is applied or inserted under pressure into the cylindrical can body (2), kept in the same vertical line (as shown in FIG. 2), said can body having a diameter sensibly reduced relative to the can body (2*a*) already stretched (as shown in FIGS. 2, 3, 4 and 5), being driven by any adequate means: mechanical, compressed air, etc., having the upper end of the can cylindrical body (2) supported and coupled in the tool formed by the disk (8), allowing for the stretching of the diameter of can body (2*a*) at its greater part, according to the diameter of the section (1) of bigger height of the forming block and with the sequence of moving, causing formation or molding of the can at its upper and conic part (3) and at the short cylindrical section (4) of smaller diameter, thus resulting the formation of an upper section (17) of lesser diameter known as 'neck-in' which allows for the use of lids of smaller diameter with raw material economy, besides stackeability increase.

The moving of the can body stretching and molding device may, without damage to its functions, obey a second operational form, in which case the drive being in the reverse sense, i.e., keeping the forming block (1) fixed and stable and being the cylindrical body (2) of the can to be stretched pressed downwards, through support on the upper end of this body (2) by the same flange forming tool (8), constituted by the steel disk (10), in such a way that said cylindrical body (2) covers the forming block (1) like a T-shirt, and getting equally the diameter and the shape of the forming block (1).

Just for mere exemplification and elucidation, are schematically shown in FIGS. 9 and 10 the economic advantages afforded by stretching and molding can bodies through the device object of present invention, taking as an example the manufacturing of a standard can of the conventional type regularly used for packaging food, with 73 mm diameter obtained, now and normally obtained by the use of a cylindrical body with same diameter (shown in FIG. 11), which blank sheet is 230,2 mm long (indicated on FIG. 12).

Through the process of stretching and molding obtained by the device in reference, said can with 73 mm diameter is obtained from a can body with 63 mm diameter (as shown in FIG. 10), resulting in a blank sheet offered with 198,8 mm of length (as indicated in FIG. 12), resulting in a 13.64% sheet economy (as indicated in the shaded part of FIG. 12), for each unit produced.

The can body stretching and molding device, object of the present invention, might be used in high production lines, by means of conjugation of a number of forming blocks (1) and respective complementary tools formed by the disks (5) and (10) mounted on a machine with rotating turret with automatic feeding of the can bodies (2) to be stretched and formed, driven by a single command, which allows substantial manufacturing costs reduction in making this kind of packaging, to the most varied dimensions and volumetric values.

What is claimed is:

1. A molding device for stretching can bodies comprising:

a generically cylindrical forming block configured to mold a can body;

a first flange forming tool disposed at a first end of the forming block and configured to form a flange at a first end of the can body; and a second flange forming tool configured to form a flange at a second end of the can body, wherein in one single operation, the can body applied to the forming block forms to an external shape of the forming block, the first end of the can body forms a first flange formed by the first flange forming tool, the second end of the can body forms a second flange formed by the second flange forming tool.

2. The molding device of claim 1, the generically cylindrical forming block comprising:

a lower section having a first diameter; and an upper section having a second diameter different from the first diameter.

3. The molding device for stretching can bodies according to claim 2 wherein the first flange forming tool comprises:

a first disk comprising:

a groove in a face of the first disk, the first disk groove corresponding to the first flange; and an inner periphery of the first disk groove having a diameter substantially equal to the first diameter of the lower section wherein the first disk is disposed with the inner periphery substantially aligning with an outer periphery defined by the first diameter of the lower section.

4. The molding device for stretching can bodies according to claims 3 or 2, the second flange forming tool further comprising:

a second disk comprising:

a groove on a face of the second disk, the second disk groove corresponding to the second flange;

an inner periphery of the second flange groove having a diameter substantially equal to the second diameter of the upper section; and a salient section surrounding the inner periphery of the second flange groove, wherein the salient section couples the second end of the can during the stretching and molding process.

5. The molding device of claim 2, wherein the upper section is conically shaped having with a base diameter substantially equal to the first diameter and an apex diameter equal to the second diameter.

6. The molding device of claim 2, wherein the second diameter is substantially equal to the inner diameter of the can body to be molded.

7. The molding device of claim 1, wherein the forming block is cast in a solid and rigid material with a hardness at least equal to that of steel.

* * * * *